US005990435A

United States Patent [19]

Chao

[11] Patent Number: 5,990,435

[45] Date of Patent: Nov. 23, 1999

[54] PUSH BUTTON SWITCH

[75] Inventor: Shih-Hung Chao, Taoyuan, Taiwan

[73] Assignee: Acer Peripherals Inc., Taoyuan, Taiwan

[21] Appl. No.: 09/190,714

[22] Filed: Nov. 12, 1998

[30] Foreign Application Priority Data

Dec. 5, 1997 [TW] Taiwan ..... 86220278

[51] Int. Cl.[6] ..... H01H 13/70

[52] U.S. Cl. ..... 200/517; 200/345

[58] Field of Search ..... 200/5 A, 512, 200/517, 520, 341, 345; 400/490, 491, 491.2, 495, 495.1, 496

[56] References Cited

U.S. PATENT DOCUMENTS

| | | | |
|---|---|---|---|
| 5,203,448 | 4/1993 | Osada et al. | 200/517 |
| 5,256,843 | 10/1993 | Chiba et al. | 200/517 |
| 5,386,091 | 1/1995 | Clancy | 200/517 |
| 5,389,755 | 2/1995 | Chen | 200/341 |
| 5,821,482 | 10/1998 | Ootani et al. | 200/5 A |

FOREIGN PATENT DOCUMENTS

| | | | |
|---|---|---|---|
| 84209542 | 7/1984 | Taiwan | G06F 3/823 |

*Primary Examiner*—Michael Friedhofer
*Attorney, Agent, or Firm*—Majestic, Parsons, Siebert & Hsue P.C.

[57] ABSTRACT

The push button switch provided includes a housing, a key cap, an elastic actuator, and a membrane switch layer. The housing has a key top guide integral with the housing, and two slots are provided at the vicinity of the key top guide. The key top has a cap and two deformable hooks. The cap has a bottom surface, and a plunger is provided and extends from the bottom surface. The two deformable hooks are provided and extend from an edge of the cap. Each deformable hook corresponds to one of the slots and is disposed within the corresponding slot. The plunger is slidably disposed within the key top guide, which allows a reciprocal movement of the key top with respect to the housing. The actuator has an elastic dome and a deformable sheet membrane integral with the elastic dome. The elastic dome supports the plunger and deforms responsive to the reciprocal movement of the key top. The membrane switch layer is disposed underneath the actuator. The deformable hook includes a hook portion, and a leg is provided and extends from the hook portion. As the key top moves downward under an external force, the leg first impacts against the deformable membrane to prevent the bottom surface of the key top from colliding against a bottom surface of the key top guide.

13 Claims, 8 Drawing Sheets

PUSH BUTTON SWITCH

FIELD OF INVENTION

The invention relates to the push button switch of a keyboard.

BACKGROUND OF INVENTION

In the common push button switch used in keyboard device, the rubber dome is used as the actuator. The rubber dome touches against a corresponding switch on the membrane circuit, and actuates the On/Off action of the switch.

To provide a feeling of comfort to the user while the push button switch is depressed, and to prevent a large noise made when the key top touches the top surface of the key top, guide the conventional approaches, using the rubber dome as the actuator, in general, are such that the key top does not impact the top surface of the guide with the rubber dome directly being used to support the key top, as the key top is depressed to its lowest position. However, as the push button switch of this design has been operated over a long time, due to the fact that the rubber dome is overly deformed each time the key top is depressed, as shown in FIG. 6, the rubber dome is easily damaged, shortens the life cycle of the keyboard.

SUMMARY OF INVENTION

To resolve the aforementioned drawback, the invention provides a push button switch with a longer life cycle, by avoiding the over deformation of the rubber dome, while retaining conventional objectives of comfort and low noise.

The push button switch includes a housing, a key cap, an elastic actuator, and a membrane switch layer.

The housing has a key top guide integral with the housing and two slots are provided at the vicinity of the key top guide.

The key top has a cap and two deformable hooks. The cap has a bottom surface, and a plunger is provided and extends from the bottom surface. The two deformable hooks are provided and extend from an edge of the cap. Each deformable hook corresponds to one of the slots and is disposed within the corresponding slot. The plunger is slidably disposed within the key top guide, which allows a reciprocal movement of the key top with respect to the housing.

The actuator has an elastic dome and a deformable sheet membrane integral with the elastic dome. The elastic dome supports the plunger and deforms responsive to the reciprocal movement of the key top.

The membrane switch layer is disposed underneath the actuator.

The deformable hook includes a hook portion, and a leg is provided and extends from the hook portion. As the key top moves downward under an external force, the leg first impacts against the deformable membrane to prevent the bottom surface of the key top from colliding against the top surface of the key top guide.

In another embodiment of the invention, the noise associating with the downward and upward movement of the key top is further reduced.

The merits of the invention may be further understood by the following recitations together with the appended drawings.

DETAILED DESCRIPTION OF THE EMBODIMENT

Figure 1:
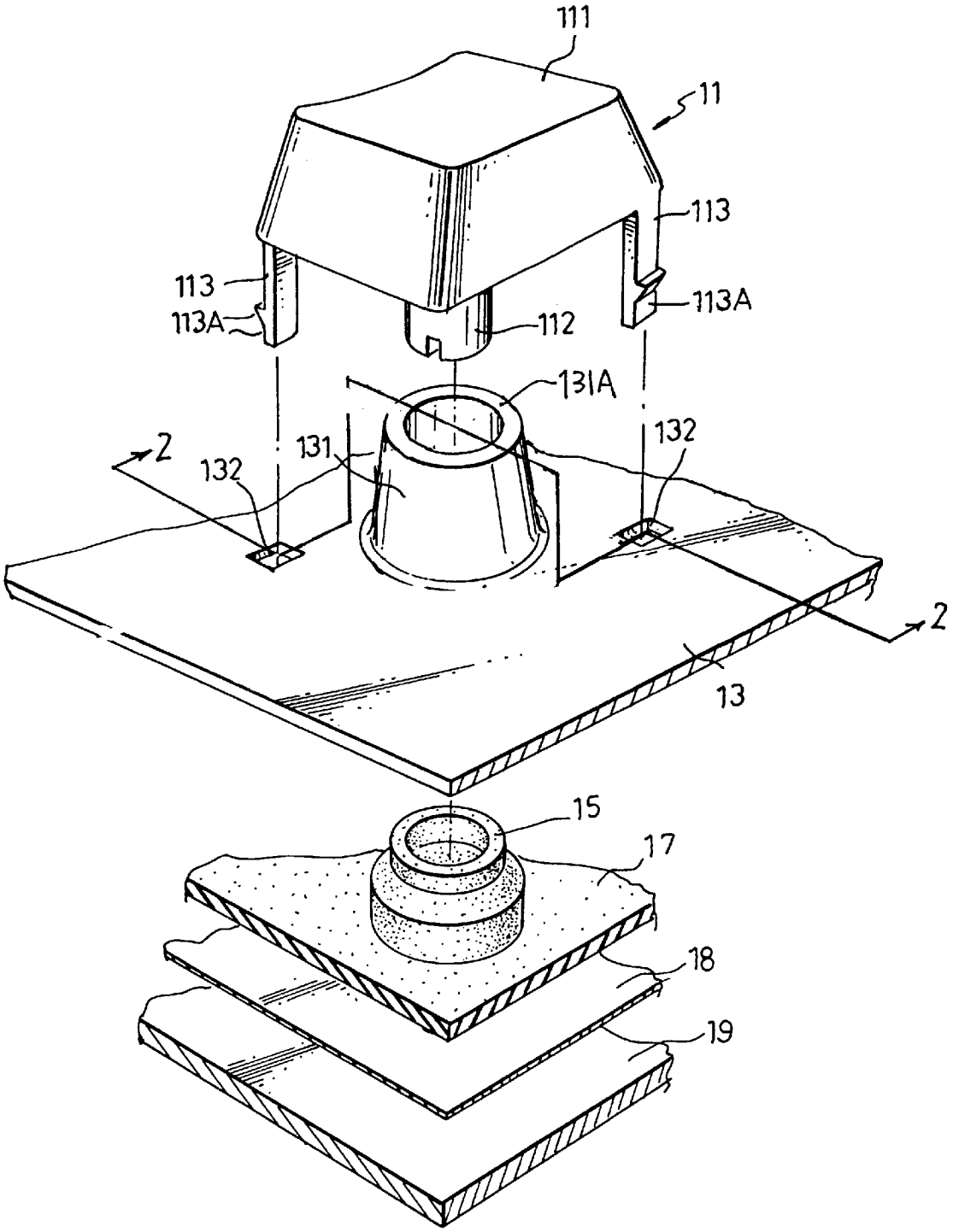
FIG. 1 shows, in an exploded view, the key top and the housing in accordance with the present invention.

As shown in FIG. 1, the push button switch of the invention includes key top 11, a housing 13, a rubber dome 15, a membrane switch layer 18 and a base plate 19. The housing 13 includes a key top guide 131 and two slots 132. The key top 11 includes a cap 111, and a plunger 112 which extends from the bottom surface of the cap 111, and two deformable hooks 113 which respectively extend from an edge of the cap 111. In an embodiment, one deformable hook is diagonal to another deformable hook with respect to the cap 111. Within one keyboard, the housing 13 includes a multiple of key top guide 131, a multiple of rubber domes 15. Furthermore, these rubber domes 15 are integral with a rubber member 17. Alternatively, to reduce cost, a single rubber dome type isolated from other rubber domes within other housings may also be implemented when the rubber member 17 is to be dispensed with. During assembly, the plunger 112 is disposed within the slot of the guide 131 and, at the same time, the two deformable hooks 113 are disposed respectively within one corresponding slot 132.

It is to be noted that a leg 113A is provided which extends from the hook portion of the deformable hook 113, and the purpose of such provision will be clear hereinafter.

Figure 2A:
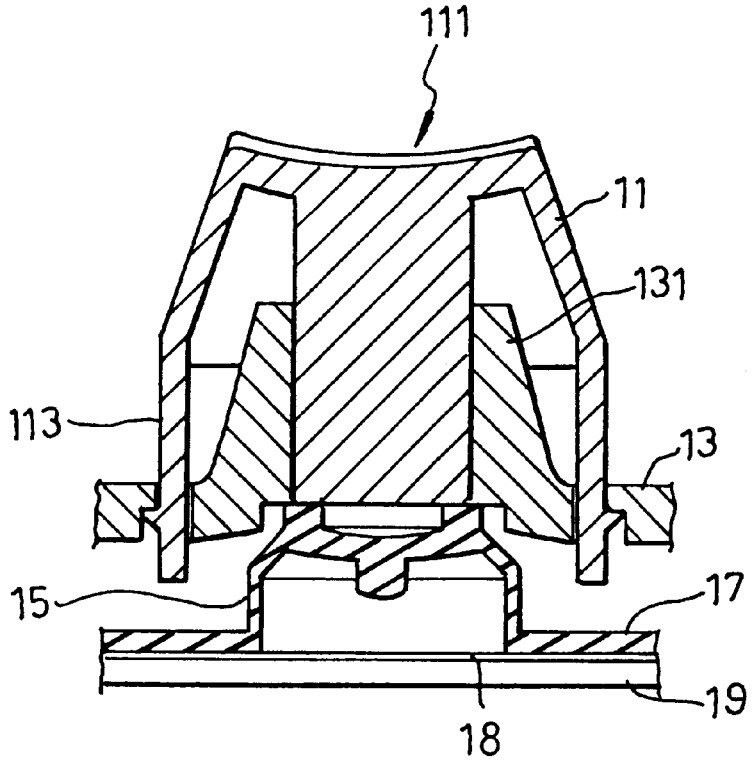
FIG. 2(A) shows the component relationship along the section line 2—2 in FIG. 1.
Figure 2B:
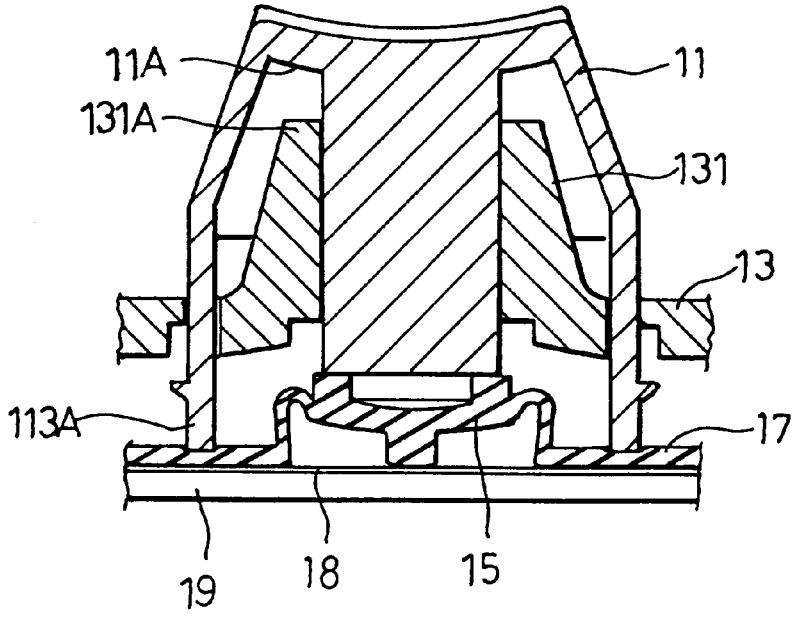
FIG. 2(B) shows the depressed condition of the switch in FIG. 2(A).

FIG. 2(A) shows the component relationship along the section line 2—2 in FIG. 1. As the push button switch of FIG. 2(A) is depressed, the push button switch moves downward to a status shown in FIG. 2(B). From FIG. 2(B), it is readily known, due to the provision of leg 113A at the deformable hook 113 of the invention, before the rubber dome 15 is overly deformed, the end of leg 113A first reaches the rubber membrane 17 at the vicinity of the rubber dome and prevents the over deformation of the rubber dome 15, compared to the conventional approach. furthermore, also due to the existence of the leg 113A, as the key top 11 moves downward due to external force, the leg 113A first touches against the rubber membrane 17, preventing the inner surface 11A of the key top 11 from impacting the corresponding top surface 131A of the key top guide 131. This avoids the impact noise between the inner surface 11A of the key top 11 and the corresponding top surface 131A of the key top guide 131.

Figure 3A:
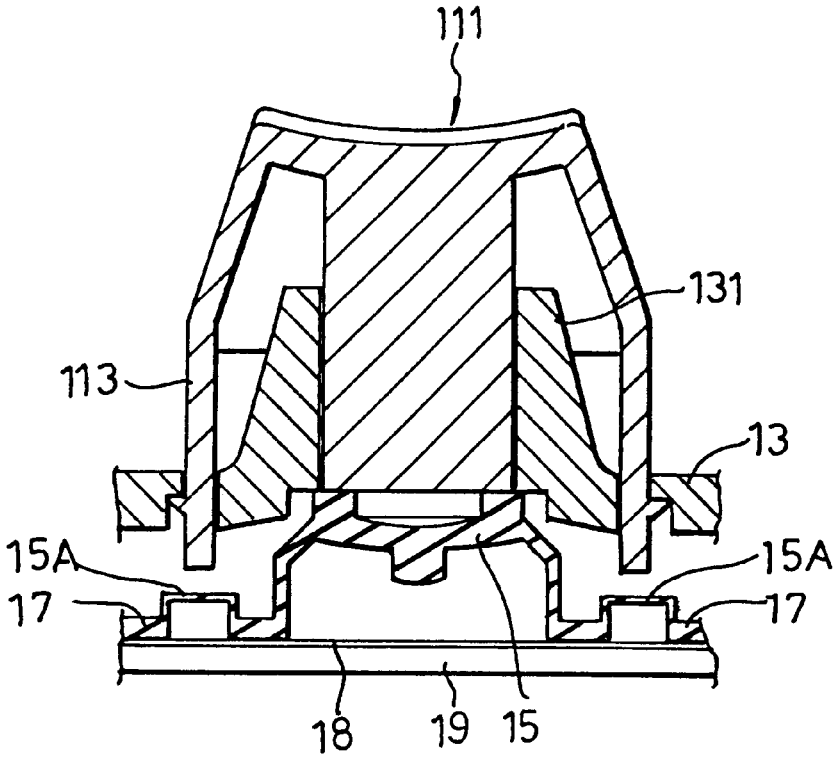
FIG. 3(A) shows another embodiment.
Figure 3B:
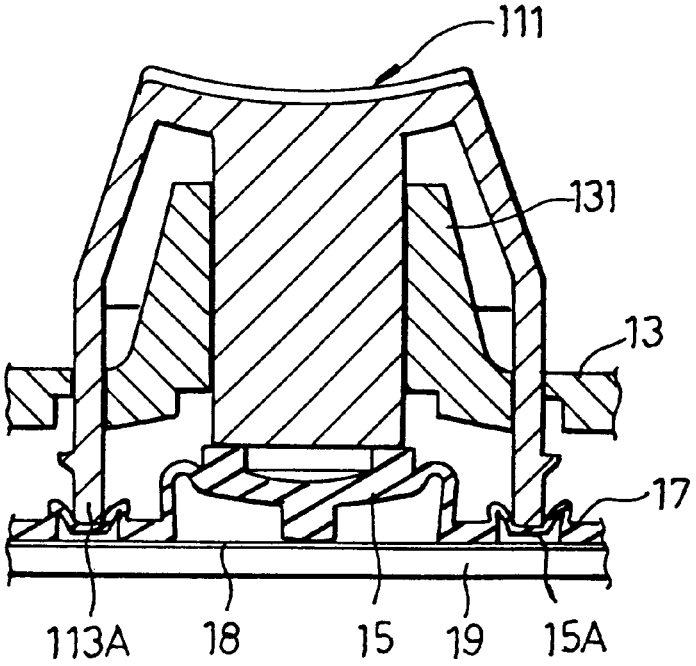
FIG. 3(B) shows the depressed condition of the switch in FIG. 3(A).

To further reduce operational noise, in the second embodiment of the invention shown in FIG. 3(A) and FIG. 3(B), the rubber membrane 1, at location corresponding to leg 113A and at the vicinity of the rubber dome 15, includes a convex portion 15A. In the preferred embodiment, an air bag space is formed by the convex portion 15A as the rubber membrane 17 is assembled with the membrane switch layer 18 and the base plate 19, as shown in FIG. 3(B). When the push button switch is depressed under this configuration, as shown in FIG. 3(B), the leg 113A touches against the convex portion 15A. Due to the action of the air bag formed by the convex portion 15A, the noise associating with the operation of the push button switch is further reduced.

Figure 4A:
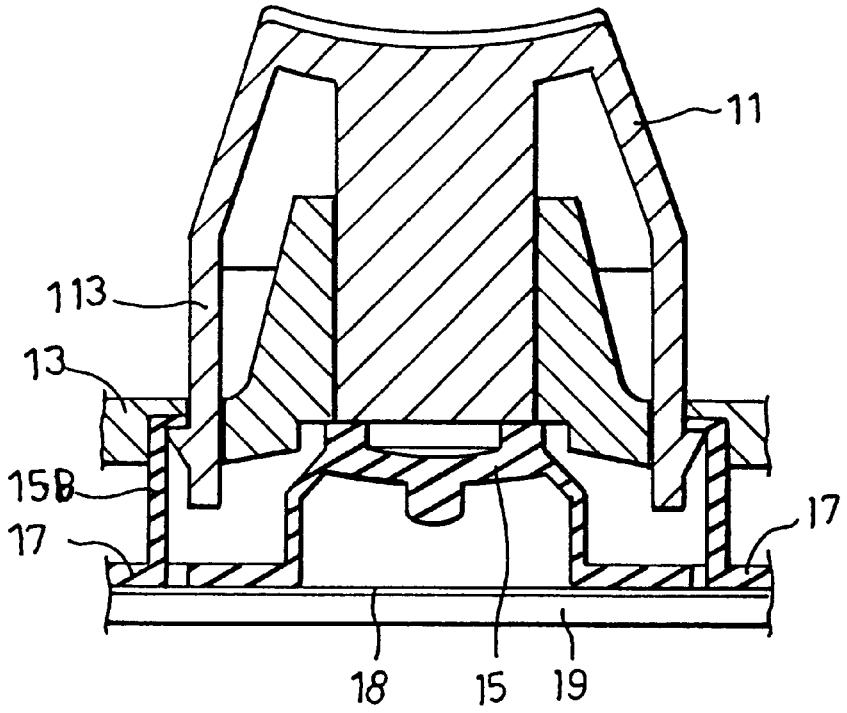
FIG. 4(A) shows the third embodiment.
Figure 4B:
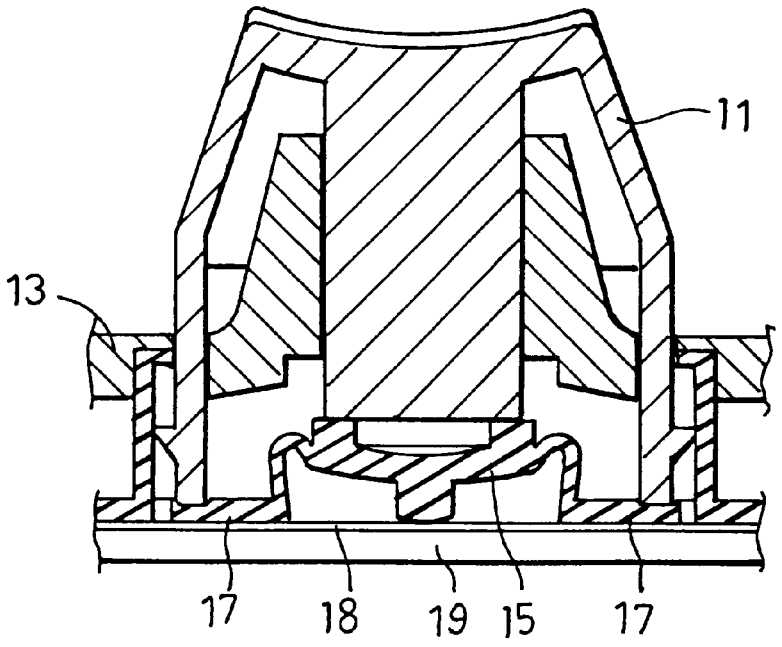
FIG. 4(B) shows the depressed condition of the switch in FIG. 4(A).

The third embodiment of the invention, as depicted in FIG. 4(A), a protrusion portion 15B extending upward from the rubber membrane 17 is provided. The location at which the protrusion portion 15B is provided substantially corresponds to the location of the hook 113. FIG. 4(B) shows the status of the push button switch while depressed. As a bounce back movement occurs from the status in FIG. 4(B) to a released condition, the hook end of the hook 113 hits the protrusion portion 15B instead of the inner surface of the housing 13. This reduces the noise associating with the bounce back movement of the push button switch. As shown, an opening on the rubber membrane 17, which is created during formation of the protrusion 15B, deteriorates the water proof function of the rubber membrane 17. To enhance the water proof function for the keyboard under this configuration, one may alternatively include one rubber sheet with provision of the mentioned protrusion 15B over another rubber membrane 17 shown in FIG. 2(A). This alternative approach provides results and functions offered by the configuration shown in FIG. 4(A) while enhancing the water proof capability.

Figure 4C:
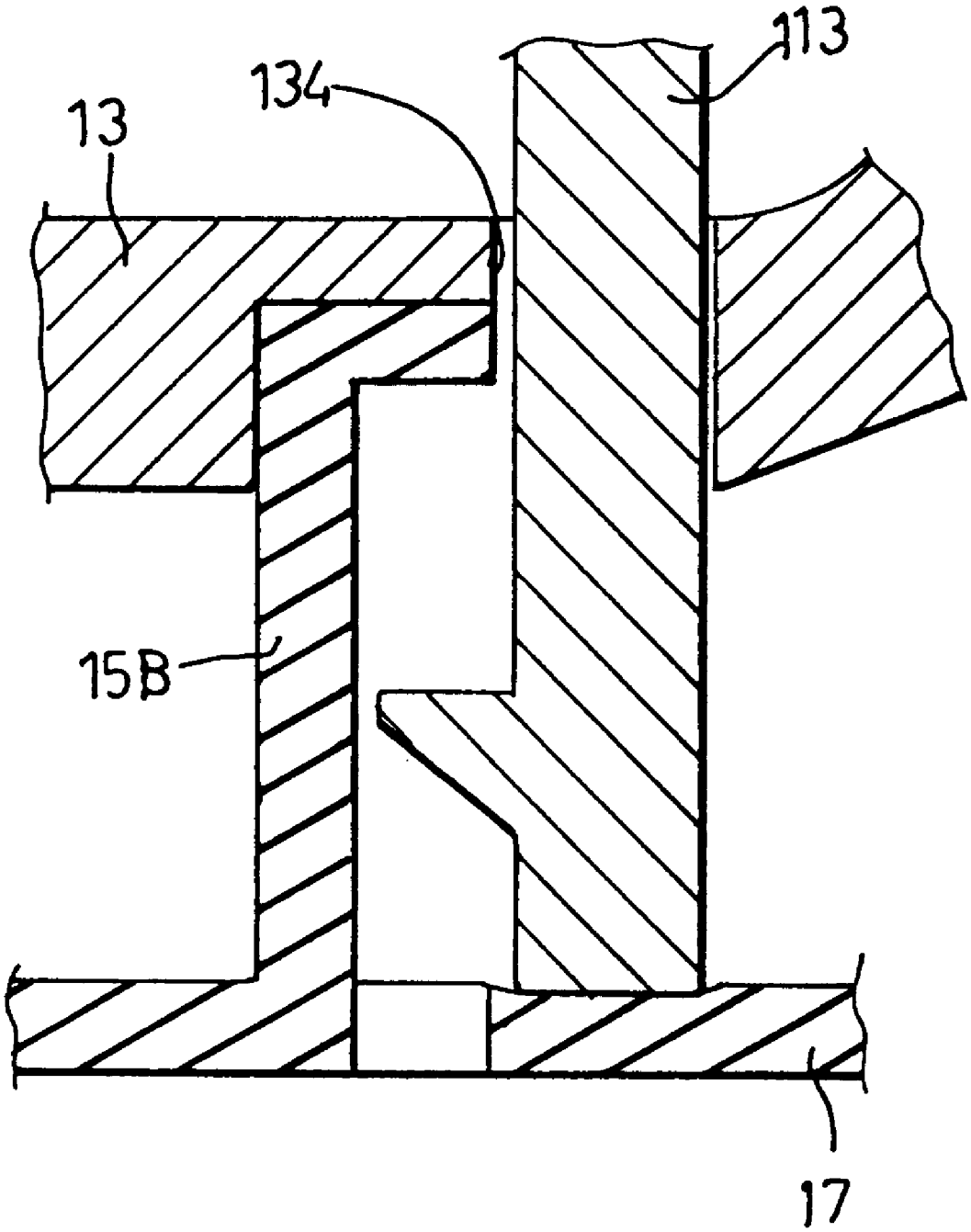
FIG. 4(C) shows an enlargement view of FIG. 4(A).

As shown in FIG. 4(C), the side edge 134 defined by the slot of the housing 13 is in line with the edge at the tip of the protrusion 15. As a result, during assembly process of the hook 113 into the slot, the hook 113 may interfere with the tip of the protrusion 15B, which causes inaccurate relative relationship between them after assembly.

Figure 5A:
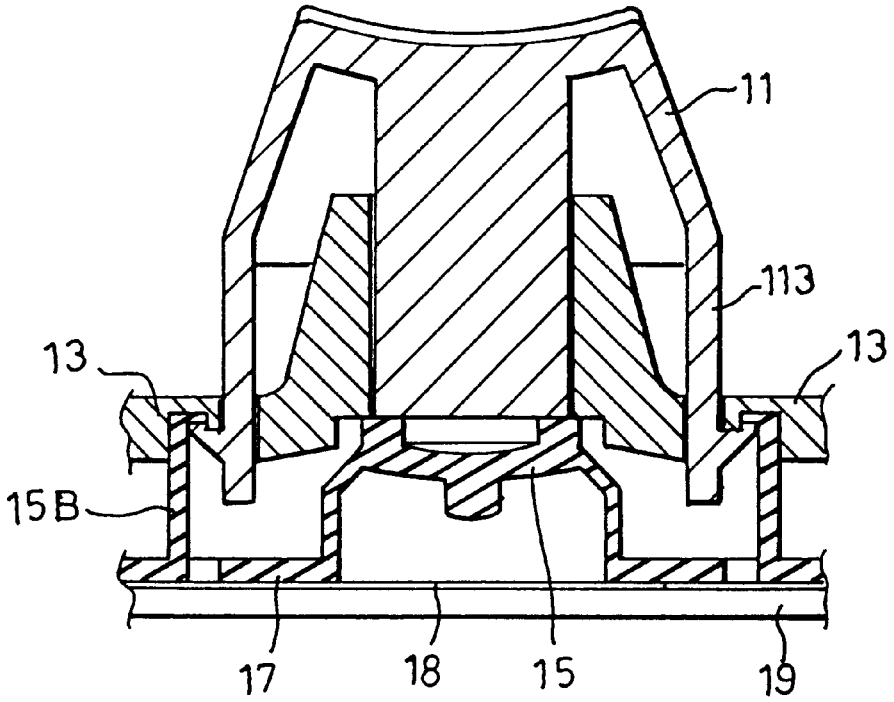
FIG. 5(A) shows an equivalent variation of FIG. 4(A).
Figure 5B:
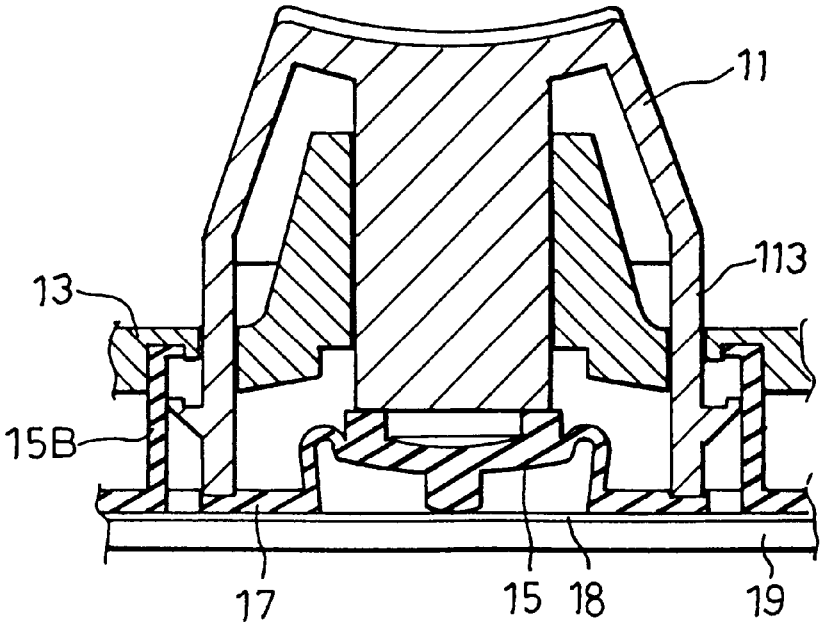
FIG. 5(B) shows the depressed condition of the switch in FIG. 5(A).
Figure 5C:
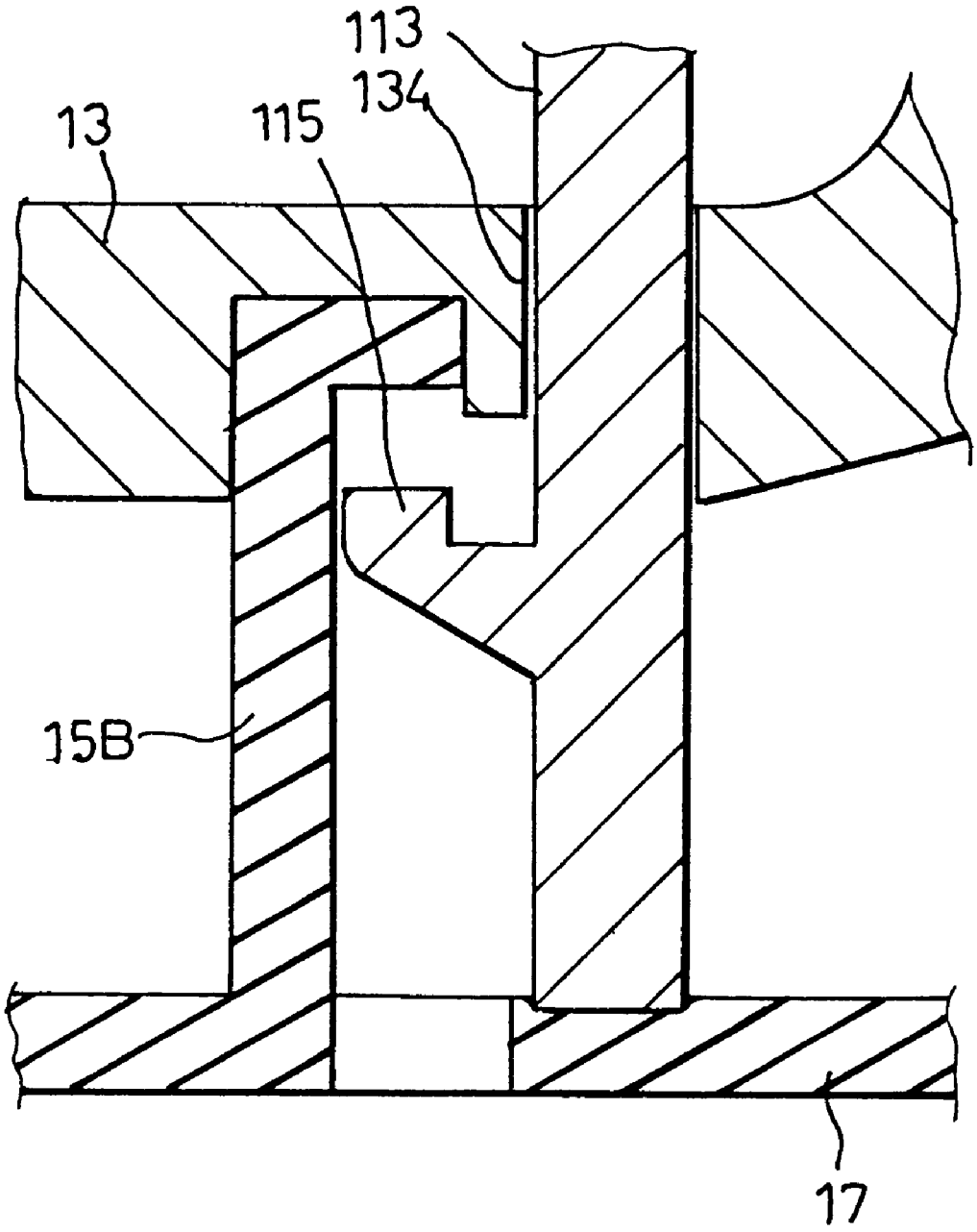
FIG. 5(C) shows an enlargement view of FIG. 5(A).
Figure 6:
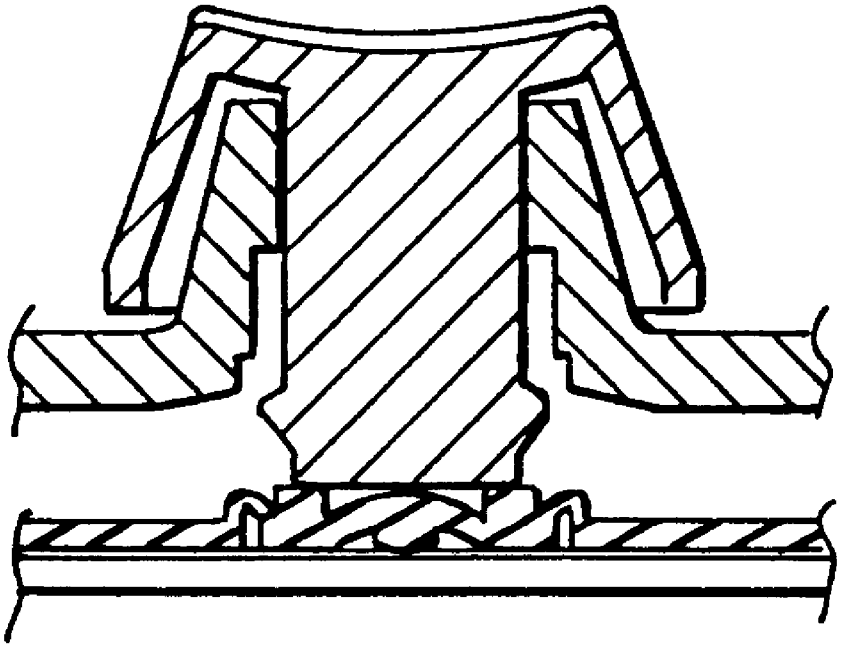
FIG. 6 (PRIOR ART)
FIG. 6 depicts an over deformation condition of the rubber dome each time key top is depressed in accordance with the conventional approach.

To this point, the design of the side edge 134 at the slot of the housing 13 is shown in FIG. 5(C). That is, a space, as shown, is provided by shape of the side edge 134 which is used to accommodate the tip of the protrusion portion 15B. During assembly of the hook 113, the hook 113 will not touch the top of the protrusion portion. Furthermore, the hook end of hook 113 extends upward to form a hook tip 115. When bouncing back, the hook tip 115 hits the protrusion portion 15B, instead of the side edge 134. This arrangement lowers the noise associated with the bouncing back of the push button switch. FIG. 5(A) shows the overall view of the push button switch implementing the design of FIG. 5(C) and FIG. 5(B) depicts a depressed status of FIG. 5(A).

What is claimed is:

1. A push button switch comprising:

a housing having a key top guide integral with the housing and two slots being provided at vicinity of the key top guide;

a key top having a cap and two deformable hooks, said cap having a bottom surface, a plunger being provided and extending from the bottom surface, the two deformable hooks being provided and extending from an edge of the cap, each of the two deformable hooks corresponding to and disposed within one of said two slots, the plunger being slidably disposed within the key top guide which allows a reciprocal movement of the key top with respect to the housing;

an actuator having an elastic dome and a deformable sheet membrane integral with the elastic dome, said elastic dome supporting the plunger and deforming responsive to the reciprocal movement of the key top; and a membrane switch layer disposed underneath the actuator;

wherein each of the two deformable hooks comprises a hook portion, a leg is provided and extending from the hook portion, as the key top moves downward under an external force, the leg first impacts against the deformable sheet membrane to prevent the bottom surface of the key top from colliding against a top surface of the key top guide.

2. The push button switch of claim 1, wherein a convex portion is provided at a predetermined location of the deformable sheet membrane for absorbing an impact force.

3. The push button switch of claim 2, wherein a configuration of the convex portion together with the membrane switch layer constitutes an air bag for absorbing the impact force.

4. The push button switch of claim 1, wherein a protrusion portion extends upward from a predetermined location of the deformable sheet membrane corresponding to one of the two defornable hooks for absorbing an impact force from the one of the two deformable hooks as the keycap bounces back.

5. The push button switch of claim 4, wherein the protrusion portion is enveloped within a space defined by a circumference of a corresponding one of the two slots for preventing a corresponding one of the two deformable hooks from touching against a top surface of the protrusion portion during assembly.

6. The push button switch of claim 1, wherein the elastic dome is a rubber dome.

7. A push button switch comprising:

a housing having a key top guide integral with the housing and N slots being provided at vicinity of the key top guide;

a key top having a cap and N deformable hooks, each of said N deformable hooks corresponding to one of said N slots, said cap having a bottom surface, a plunger being provided and extending from the bottom surface, each of said N deformable hooks being provided and extending from an edge of the cap and disposed within a corresponding one of said N slots, the plunger being slidably disposed within the key top guide which allows a reciprocal movement of the key top with respect to the housing;

an actuator having an elastic dome, the elastic dome supporting the plunger and deforming responsive to the reciprocal movement of the key top; and a membrane switch layer disposed underneath the actuator;

wherein each of said N deformable hooks comprises a hook portion, a leg is provided and extending from the hook portion, as the key top moves downward under an external force, the leg first prevents the bottom surface of the key top from colliding against a top surface of the key top guide.

8. The push button switch of claim 7, wherein the elastic dome is a rubber dome.

9. The push button switch of claim 7, wherein the actuator further comprises a deformable rubber membrane integral with the elastic dome.

10. The push button switch of claim 9, wherein a convex portion is provided at a predetermined location of the deformable rubber membrane for absorbing an impact force.

11. The push button switch of claim 10, wherein a configuration of the convex portion together with the membrane switch layer constitutes an air bag for absorbing the impact force.

12. The push button switch of claim 9, wherein a protrusion portion extends upward from a predetermined location of the deformable rubber membrane corresponding to one of the N deformable hooks for absorbing an impact force from the one of the N deformable hooks as the keycap bounces back.

13. The push button switch of claim 12, wherein the protrusion portion is enveloped within a space defined by a circumference of a corresponding one of the N slots for preventing a corresponding one of the N deformable hooks from touching against a top surface of the protrusion portion during assembly.

* * * * *